United States Patent [19]

Sabranski

[11] 4,291,624

[45] Sep. 29, 1981

[54] EXPLOSIVE CHARGES

[75] Inventor: Udo Sabranski, Willich, Fed. Rep. of Germany

[73] Assignee: Rheinmetall GmbH, Duesseldorf, Fed. Rep. of Germany

[21] Appl. No.: 60,888

[22] Filed: Jul. 26, 1979

Related U.S. Application Data

[63] Continuation-in-part of Ser. No. 876,837, Feb. 10, 1978, abandoned.

[30] Foreign Application Priority Data

Feb. 12, 1977 [DE] Fed. Rep. of Germany ..... 2706060

[51] Int. Cl.[3] ..... F42B 1/02

[52] U.S. Cl. ..... 102/307; 102/306; 102/476

[58] Field of Search ..... 102/24 HC, 565 C

[56] References Cited

U.S. PATENT DOCUMENTS

| | | | |
|---|---|---|---|
| 2,628,559 | 2/1953 | Jasse | 102/24 HC |
| 3,736,875 | 6/1973 | Bucklishch | 102/24 HC |

FOREIGN PATENT DOCUMENTS

| | | | |
|---|---|---|---|
| 2308906 | 11/1976 | France | 102/24 HC |
| 714747 | 9/1954 | United Kingdom | 102/24 HC |

*Primary Examiner*—Peter A. Nelson

[57] ABSTRACT

An explosive charge is disclosed having air cavities in the explosive material, so situated within the material as to guide the propagation of the shock wave produced by detonation in a predetermined direction.

6 Claims, 5 Drawing Figures

EXPLOSIVE CHARGES

This application is a continuation-in-part of co-pending application Ser. No. 876,837, filed Feb. 10, 1978, and now abandoned.

BACKGROUND OF THE INVENTION

The present invention relates to an explosive charge having a predetermined direction of explosion. The invention relates particularly to hollow charges.

Explosive charges which act in a predetermined direction are well known in the art and are used in a variety of applications. Hollow charges are the most widely known and used type of such directional explosive charges. They are used in the iron and steel industry for unblocking tapholes during smelting where a fireproof plugging substance had been used. Armament applications include anti-tank missiles and armor piercing charges.

To achieve a predetermined direction of explosive force, it is necessary to alter the shape of the shock wave produced by detonation so as to produce the maximum force in the direction desired. The conventional directional explosive charge uses inert bodies imbedded in the explosive material to provide the necessary damping of the shock wave in a predetermined area of its propagation.

Since the explosive effect in hollow charges takes place in a matter of microseconds, a particularly high degree of precision in the shape and position of the inert body relative to the explosive charge is required. This complicates the manufacture of the hollow charge. In addition, the presence of an inert body, having a substantial density, which does not contribute to the explosive power of a hollow charge, increases the dead weight of the charge without a proportional increase in fire power. This results in a less efficient explosive charge. Furthermore, inert bodies require a sufficiently strong casing which further increases the dead weight of the charge, with a consequent decrease in efficiency.

In the case of anti-tank missiles and penetration charges for military use, inert body type hollow charges are also detrimental to the logistics of military operations. The increased space requirements for such missiles decreases the quantity of ammunition capable of being carried resulting in a decrease in combat efficiency.

SUMMARY OF THE INVENTION

According to the present invention, the problem of controlling and shaping the shock wave is considerably simplified by use of air cavities, rather than inert bodies, in appropriate areas of the explosive charge. Furthermore, by reducing the dead weight of the charge its efficiency related to its weight is considerably increased.

BRIEF DESCRIPTION OF THE DRAWING

Although such novel features believed to be characteristic of the invention are pointed out in the claims, the invention may be further understood by reference to the description following and the accompanying drawings, in which:

DETAILED DESCRIPTION

Figure 1:
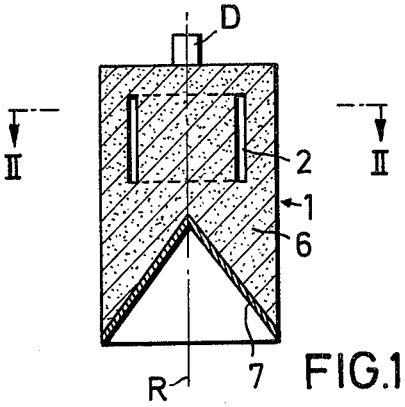
FIG. 1 is a vertical section of the present invention through an axis of symmetry.
Figure 2:
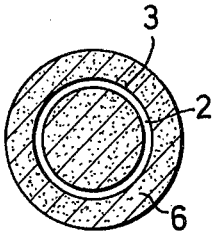
FIG. 2 is a section of FIG. 1 at lines II—II.

In the embodiment illustrated in FIGS. 1 and 2, the hollow charge 1 contains the explosive 6, within which is located an annular groove-like cavity 2 arranged along a circle 3 and extending axially at a predetermined distance from the rotational axis R. At one end, the hollow charge 1 is provided with a detonator D. The other end contains a hollow chamber with a lining 7. This embodiment is particularly suited for small calibre hollow charges.

Figure 3:
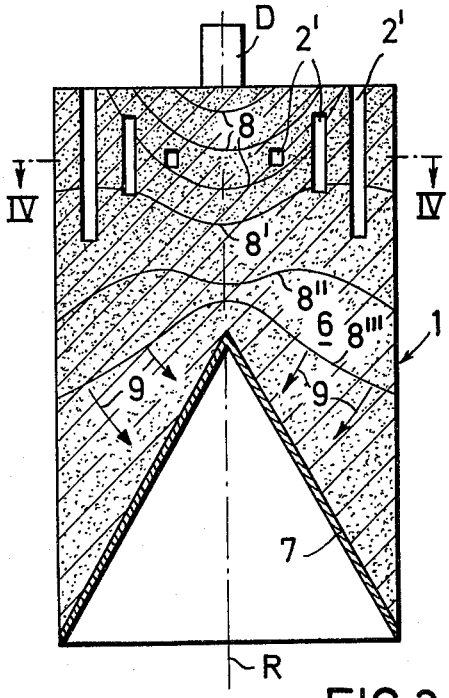
FIG. 3 is a vertical section of another embodiment of the present invention through an axis of symmetry.
Figure 4:
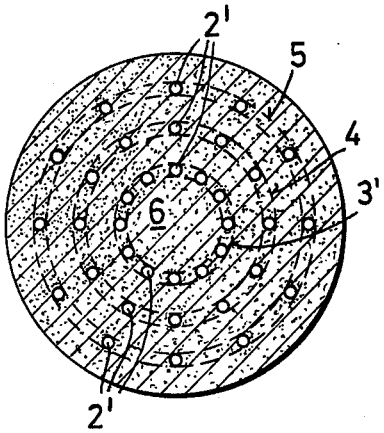
FIG. 4 is a section of FIG. 3 at lines IV—IV.

In the embodiment illustrated in FIGS. 3 and 4, the hollow charge 1, of a comparatively larger calibre, contains the explosive 6, within which is located a plurality of cylindrical air cavities 2'. In the preferred embodiment shown, the cylindrical cavities 2' are arranged along concentric circles 3', 4 and 5. The lengths of the cavities increase progressively in both axial directions from the innermost circle 3', through the middle circle 4, to the outermost circle 5. The cavities 2' lie along common radial lines (not shown) through circles 3', 4 and 5.

Test results have shown that the present invention used as an axially symmetrical hollow charge with a lined hollow chamber causes the reaction described below.

The detonation of the explosive 6 produces shock waves shown by lines 8 in FIG. 3. As the shock wave enters the various air cavities 2' it causes the air to compress. This compression and the subsequent achievement of stable pressure equilibrium causes that portion of the wave front in the respective cavities 2' to move ahead of the remainder of the wave front at a constant speed. With increasing proximity to the lining 7, the shape of the advancing shock wave is altered from that shown by lines 8 to the shape shown by lines 8', 8'', and 8'''. The force lines 9 produced as the shock wave reaches the lining 7 result in the maximum force being achieved in the predetermined direction.

Figure 5:
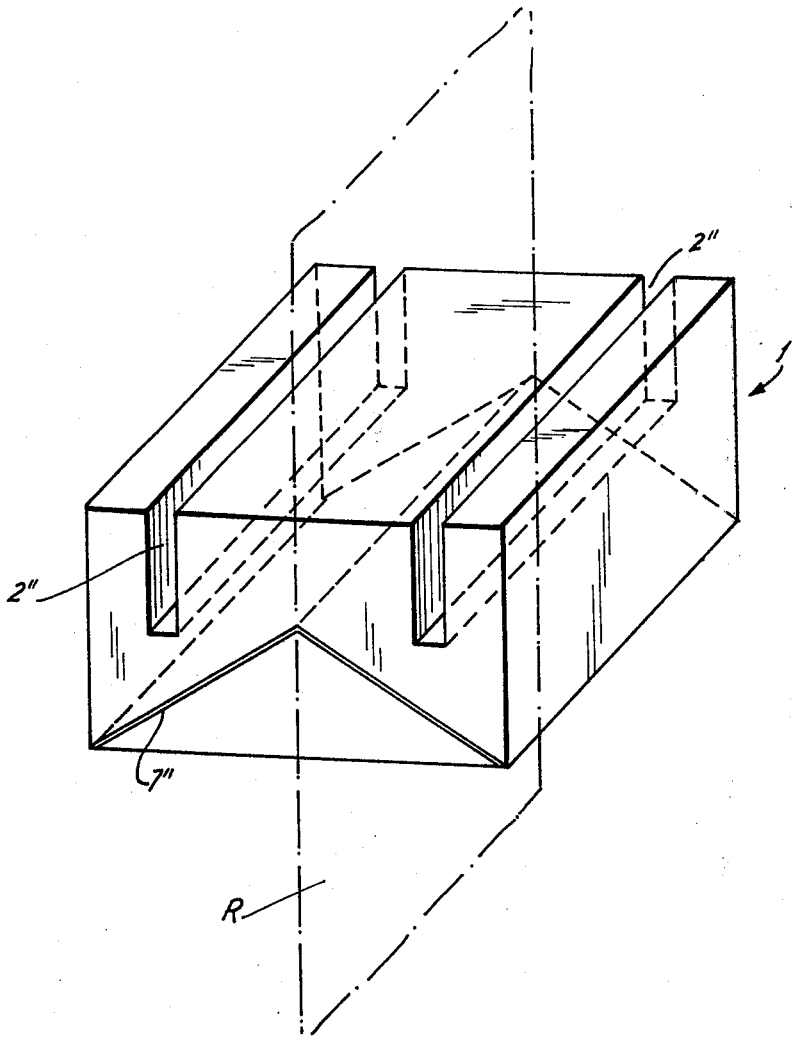
FIG. 5 is a perspective view of yet another embodiment of the invention.

FIG. 5 illustrates in perspective yet another embodiment of the invention in which the hollow charge 1'' is formed and shaped mirror-symmetrically about a central plane R. In this embodiment the air cavities 2'' extend parallel to the plane R. A liner 7'' is also provided. The air cavities 2'' have a rectangular cross-section with respect to a plane normal to the central plane R.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. An explosive charge comprising:

a casing, a detonator mounted on top of the casing, explosive material disposed within the casing and forming a hollow charge, air cavity means being equidistantly positioned with respect to a reference line which is being selected from the group of reference lines consisting of an axis of rotation or a line forming the intersection of two planes of symmetry, so that the shock wave produced by detonation is formed in a predetermined direction, said air cavity means being quadrilateral in cross-section with respect to a plane containing said reference line and said air cavity means.

2. An explosive charge as recited in claim 1, wherein the explosive material contains an annular cavity forming said air cavity means at a predetermined radial distance from the axis of rotation of the casing and of a predetermined length.

3. An explosive charge as recited in claim 1, wherein the explosive material contains a plurality of air cavities forming said air cavity means arranged along concentric circles about the axis of rotation of the casing and progressively increasing in length in both axial directions from the innermost circle to the outermost circle.

4. An explosive charge as recited in claim 3, wherein the explosive material contains cavities forming said air cavity means which are circular in cross-section in a plane perpendicular to said axis of rotation.

5. An explosive charge as recited in claim 1, wherein said air cavities forming said air cavity means are symmetrically disposed about said line passing through said plane of symmetry and transversely with respect to a plane extending normally between opposite exterior sides of said hollow charge.

6. A process for directing the shock wave produced by detonation of a hollow explosive charge by means of a detonator comprising the steps of (a) causing the shock wave to release in a predetermined portion of its propagation path a concentration partial shock surge and to enter predetermined air cavities disposed in its propagation path to compress the air therein and to achieve stable pressure equilibrium therein providing an air cavity means disposed substantially parallel to the direction of the shock wave, said means having a quadrilateral cross-section with respect to a plane containing a center-line of said charge and said air cavity means, (b) after the shock surge of the respective shock wave has stabilized causing the shock wave to propagate further at a constant propagation speed; and (c) causing in the further propagation of the shock wave the formation of a shock wave front of a predetermined effective profile.

* * * * *